US011174559B2

(12) United States Patent
Horn et al.

(10) Patent No.: US 11,174,559 B2
(45) Date of Patent: Nov. 16, 2021

(54) PROCESS FOR PREPARING ALKALI METAL ALKOXIDES IN A THREE-CHAMBER ELECTROLYSIS CELL

(71) Applicant: Evonik Functional Solutions GmbH, Niederkassel (DE)

(72) Inventors: Michael Horn, Niederkassel (DE); Philip Heinrich Reinsberg, Bonn (DE); Felix Gärtner, Haltern am See (DE); Jutta Malter, Siegburg (DE); Patrik Stenner, Hanau (DE); Tobias Stadtmüller, Seligenstadt (DE)

(73) Assignee: Evonik Functional Solutions GmbH, Niederkassel (DE)

( * ) Notice: Subject to any disclaimer, the term of this patent is extended or adjusted under 35 U.S.C. 154(b) by 0 days.

(21) Appl. No.: 17/204,629

(22) Filed: Mar. 17, 2021

(65) Prior Publication Data

US 2021/0301409 A1 Sep. 30, 2021

(30) Foreign Application Priority Data

Mar. 24, 2020 (EP) ..... 20165238

(51) Int. Cl.
*C25B 3/07* (2021.01)
*C25B 3/13* (2021.01)
*C25B 3/25* (2021.01)

(52) U.S. Cl.
CPC . *C25B 3/13* (2021.01); *C25B 3/07* (2021.01)

(58) Field of Classification Search
CPC ..... C25B 3/07; C25B 3/13; C25B 3/25
USPC ..... 205/457
See application file for complete search history.

(56) References Cited

U.S. PATENT DOCUMENTS

| | | | | |
|---|---|---|---|---|
| 5,389,211 | A | 2/1995 | Sharifian et al. | |
| 5,425,856 | A | 6/1995 | Buckholtz et al. | |
| 6,217,728 | B1 | 4/2001 | Lehmann et al. | |
| 6,221,225 | B1 | 4/2001 | Mani | |
| 2003/0106805 | A1 | 6/2003 | Horn | |
| 2006/0169594 | A1 | 8/2006 | Balagopal et al. | |
| 2006/0226022 | A1 | 10/2006 | Balagopal et al. | |
| 2007/0158205 | A1 | 7/2007 | Balagopal et al. | |
| 2008/0142373 | A1* | 6/2008 | Joshi | C25B 3/25 205/450 |

(Continued)

FOREIGN PATENT DOCUMENTS

| | | |
|---|---|---|
| DE | 42 33 191 | 7/1993 |
| DE | 103 60 758 | 7/2005 |

(Continued)

OTHER PUBLICATIONS

U.S. Appl. No. 10/282,252, filed Oct. 29, 2002, 2003/0106805, Michael Horn.

(Continued)

*Primary Examiner* — Edna Wong
(74) *Attorney, Agent, or Firm* — Grüneberg and Myers PLLC

(57) ABSTRACT

A process for electrochemical preparation of an alkali metal alkoxide solution is performed in an electrolysis cell having three chambers. The middle chamber is separated from the cathode chamber by a solid-state electrolyte permeable to cations, for example NaSICON, and from the anode chamber by a diffusion barrier, for example a membrane selective for cations or anions.

15 Claims, 3 Drawing Sheets

(56) References Cited

U.S. PATENT DOCUMENTS

| | | | |
|---|---|---|---|
| 2008/0173540 | A1 | 7/2008 | Joshi et al. |
| 2010/0044242 | A1 | 2/2010 | Bhavaraju et al. |
| 2011/0259736 | A1 | 10/2011 | Balagopal et al. |
| 2012/0085657 | A1 | 4/2012 | Bhavaraju |
| 2014/0008239 | A1 | 1/2014 | Bhavaraju |

FOREIGN PATENT DOCUMENTS

| | | |
|---|---|---|
| WO | 2008/076327 | 6/2008 |
| WO | 2009/059315 | 5/2009 |
| WO | 2009/073062 A2 | 6/2019 |
| WO | 2009/073062 A3 | 6/2019 |

OTHER PUBLICATIONS

U.S. Appl. No. 17/207,862, filed Mar. 22, 2021, Michael Horn.
European Search Report dated Sep. 18, 2020 in European Application No. 20165238.5, 5 pages.

* cited by examiner

PROCESS FOR PREPARING ALKALI METAL ALKOXIDES IN A THREE-CHAMBER ELECTROLYSIS CELL

CROSS-REFERENCE TO RELATED APPLICATIONS

This application claims priority to European Patent Application No. 20165238.5, filed Mar. 24, 2020, incorporated herein by reference.

BACKGROUND OF THE INVENTION

Field of the Invention

The present invention relates to a process for electrochemical preparation of an alkali metal alkoxide solution. The process is performed in an electrolysis cell having three chambers, wherein the middle chamber is separated from the cathode chamber by a solid-state electrolyte permeable to cations, for example NaSICON, and from the anode chamber by a diffusion barrier, for example a membrane selective for cations or anions.

Description of Related Art

The electrochemical preparation of alkali metal alkoxide solutions is an important industrial process which is described, for example, in DE 103 60 758 A1, US 2006/0226022 A1 and WO 2005/059205 A1. The principle of these processes is an electrolysis cell in which the solution of an alkali metal salt, for example sodium chloride or NaOH, is present in the anode chamber, and the alcohol in question or an alcoholic solution with a low concentration of the alkali metal alkoxide in question, for example sodium methoxide or sodium ethoxide, is present in the cathode chamber. The cathode chamber and the anode chamber are separated by a ceramic that conducts the alkali metal ion used, for example NaSICON or analogues thereof for potassium or lithium. On application of a current, chlorine forms at the anode—when a chloride salt of the alkali metal is used—and hydrogen and alkoxide ions at the cathode. The result of the balancing of charge is that alkali metal ions migrate from the middle chamber into the cathode chamber via the ceramic that is selective therefor. The balancing of charge between middle chamber and anode chamber results from the migration of cations when cation exchange membranes are used or the migration of anions when anion exchange membranes are used, or from migration of both ion types when non-specific diffusion barriers are used. This increases the concentration of the alkali metal alkoxide in the cathode chamber and the concentration of the sodium ions in the anolyte is lowered.

NaSICON solid-state electrolytes are also used in the electrochemical preparation of other compounds:

WO 2014/008410 A1 describes an electrolytic process for preparing elemental titanium or rare earths. The basis of this process is that titanium chloride is formed from $TiO_2$ and the corresponding acid, and this is reacted with sodium alkoxide to give titanium alkoxide and NaCl and finally converted electrolytically to elemental titanium and sodium alkoxide.

WO 2007/082092 A2 and WO 2009/059315 A1 describe processes for producing biodiesel, in which, with the aid of alkoxides prepared electrolytically by means of NaSICON, triglycerides are first converted to the corresponding alkali metal triglycerides and are reacted in a second step with electrolytically generated protons to give glycerol and the respective alkali metal hydroxide.

The prior art accordingly describes processes that are performed in electrolysis cells with an ion-permeable layer, for example NaSICON solid-state electrolytes. However, these solid-state electrolytes typically have the disadvantage that they lack long-term stability toward aqueous acids. This is problematic in that, during the electrolysis in the anode chamber, the pH falls as a result of oxidation processes (for example in the case of preparation of halogens by disproportionation or by oxygen formation). These acidic conditions attack the NaSICON solid-state electrolyte to such a degree that the process cannot be used on the industrial scale. In order to counter this problem, various approaches have been described in the prior art.

For instance, three-chamber cells have been proposed in the prior art. These are known in the field of electrodialysis, for example U.S. Pat. No. 6,221,225 B1.

WO 2012/048032 A2 and US 2010/0044242 A1 describe, for example, electrochemical processes for preparing sodium hypochlonte and similar chlorine compounds in such a three-chamber cell. The cathode chamber and the middle chamber of the cell are separated here by a solid-state electrolyte permeable to cations, for example NaSICON. In order to protect this from the acidic anolyte, the middle chamber is supplied, for example, with solution from the cathode chamber. US 2010/0044242 A1 also describes, in FIG. 6, the possibility of mixing solution from the middle chamber with solution from the anode chamber outside the chamber in order to obtain sodium hypochlorite.

Such cells have also been proposed in the prior art for the preparation or purification of alkali metal alkoxides.

For instance. U.S. Pat. No. 5,389,211 A describes a process for purifying alkoxide solutions in which a three-chamber cell is used, in which the chambers are delimited from one another by cation-selective solid-state electrolytes or else nonionic dividing walls. The middle chamber is used as buffer chamber in order to prevent the purified alkoxide or hydroxide solution from the cathode chamber from mixing with the contaminated solution from the anode chamber.

WO 2008/076327 A1 describes a process for preparing alkali metal alkoxides. This uses a three-chamber cell, the middle chamber of which has been filled with alkali metal alkoxide (see, for example, paragraphs [0008] and [0067] of WO 2008/076327 A1). This protects the solid-state electrolyte separating the middle chamber and the cathode chamber from the solution present in the anode chamber, which becomes more acidic in the course of electrolysis. However, this arrangement has the disadvantage that the alkali metal alkoxide solution is the desired product, but this is consumed and continuously contaminated as buffer solution. A further disadvantage of the process described in WO 2008/076327 A1 is that the formation of the alkoxide in the cathode chamber depends on the diffusion rate of the alkali metal ions through two membranes or solid-state electrolytes. This in turn leads to slowing of the formation of the alkoxide.

It was therefore an object of the present invention to provide an improved process for electrolytic preparation of alkali metal alkoxide which ensures protection of the cation-conducting solid-state electrolyte from acid but does not have the aforementioned disadvantages. In addition, the process is to feature more sparing use of the reactants compared to the prior art.

SUMMARY OF THE INVENTION

A process which achieves the object of the invention has now surprisingly been found.

The process according to the invention is one for preparing a solution $L_1$ <115> of an alkali metal alkoxide XOR in the alcohol ROH in an electrolysis cell E <100>, wherein E <100> comprises at least one anode chamber $K_A$ <101>, at least one cathode chamber $K_K$ <102> and at least one interposed middle chamber $K_M$ <103>, wherein $K_A$ <101> comprises an anodic electrode $E_A$ <104> and an outlet AKA <106>, wherein $K_K$ <102> comprises a cathodic electrode $E_K$ <105>, an inlet $Z_{KK}$ <107> and an outlet $A_{KK}$ <109>, wherein $K_M$ <103> comprises an inlet $Z_{KM}$ <108>, is separated from $K_A$ <101> by a diffusion barrier D <110> and is separated from $K_K$ <102> by an alkali metal cation-conducting solid-state electrolyte $F_K$ <111>, wherein $K_A$ <101> and $K_M$ <103> are connected to one another by a connection $V_{AM}$ <112> through which liquid can be routed from $K_M$ <103> into $K_A$ <101>, wherein the process comprises the following steps (a), (b) and (c) that proceed simultaneously:

(a) a solution $L_2$ <113> comprising the alcohol ROH and preferably comprising at least one alkali metal alkoxide XOR is routed through $K_K$ <102>, (b) a neutral or alkaline, aqueous solution $L_3$ <114> of a salt S comprising X as cation is routed through $K_M$ <103>, then via $V_{AM}$ <112>, then through $K_A$ <101>, (c) voltage is applied between $E_A$ <104> and $E_K$ <105>, which affords the solution $L_1$ <115> at the outlet $A_{KK}$ <109>, wherein the concentration of XOR in $L_1$ <115> is higher than in $L_2$ <113>.

and which affords an aqueous solution $L_4$ <116> of S at the outlet $A_{KA}$ <106>, wherein the concentration of S in $L_4$ <116> is lower than in $L_3$ <114>.

wherein X is an alkali metal cation and R is an alkyl radical having 1 to 4 carbon atoms.

The invention also includes the following embodiments:

1. Process for preparing a solution $L_1$ <115> of an alkali metal alkoxide XOR in the alcohol ROH in an electrolysis cell E <100>.

wherein E <100> comprises at least one anode chamber $K_A$ <101>, at least one cathode chamber $K_K$ <102> and at least one interposed middle chamber $K_M$ <103>, wherein $K_A$ <101> comprises an anodic electrode $E_A$ <104> and an outlet AKA <106>.

wherein $K_K$ <102> comprises a cathodic electrode $E_K$ <105>, an inlet $Z_{KK}$ <107> and an outlet $A_{KK}$ <109>, wherein $K_M$ <103> comprises an inlet $Z_{KM}$ <108>, is separated from $K_A$ <101> by a diffusion barrier D <110> and is separated from $K_K$ <102> by an alkali metal cation-conducting solid-state electrolyte $F_K$ <111>, wherein $K_M$ <103> and $K_A$ <101> are connected to one another by a connection $V_{AM}$ <112> through which liquid can be routed from $K_M$ <103> into $K_A$ <101>, wherein the process comprises the following steps (a), (b) and (c) that proceed simultaneously:

(a) a solution $L_2$ <113> comprising the alcohol ROH and preferably additionally comprising at least one alkali metal alkoxide XOR is routed through $K_K$ <102>, (b) a neutral or alkaline, aqueous solution $L_3$ <114> of a salt S comprising X as cation is routed through $K_M$, then via $V_{AM}$, then through $K_A$ <101>, (c) voltage is applied between $E_A$ <104> and $E_K$ <105>, which affords the solution $L_1$ <115> at the outlet $A_{KK}$ <109>, wherein the concentration of XOR in $L_1$ <115> is higher than in $L_2$ <113>, and which affords an aqueous solution $L_4$ <116> of S at the outlet AKA <106>, wherein the concentration of S in $L_4$ <116> is lower than in $L_3$ <114>, wherein X is an alkali metal cation and R is an alkyl radical having 1 to 4 carbon atoms.

2. Process according to Embodiment 1, wherein X is selected from the group consisting of $Li^+$, $Na^+$, $K^+$.

3. Process according to Embodiment 1 or 2, wherein S is a halide, sulfate, sulfite, nitrate, hydrogencarbonate or carbonate of X.

4. Process according to any of Embodiments 1 to 3, wherein R is selected from the group consisting of methyl and ethyl.

5. Process according to any of Embodiments 1 to 4, wherein the diffusion barrier D <110> is selected from the group consisting of cation-conducting and anion-conducting membranes.

6. Process according to Embodiment 5, wherein the diffusion barrier D <110> is a sodium cation-conducting membrane.

7. Process according to any of Embodiments 1 to 6, wherein the flow direction of $L_3$ <114> in the middle chamber $K_M$ <103> is the opposite of the flow direction of $L_3$ <114> in the anode chamber $K_A$ <101>.

8. Process according to any of Embodiments 1 to 7, wherein the connection $V_{AM}$ <112> is formed within and/or outside the electrolysis cell E <100>.

9. Process according to any of Embodiments 1 to 8, wherein the connection $V_{AM}$ <112> between middle chamber $K_M$ <103> and anode chamber $K_A$ <101> is arranged in such a way that at least a portion of the aqueous solution $L_3$ <114> flows completely through the middle chamber $K_M$ <103> and the anode chamber $K_A$ <101>.

10. Process according to any of Embodiments 1 to 9, wherein the alkali metal ion-conducting solid-state electrolyte $F_K$ <111> has a structure of the formula $$M^{I}_{1+2w+x-y+z}M^{II}_{w}M^{III}_{x}Zr^{IV}_{2-w-x-y}M^{V}_{y}(SiO_4)_z(PO_4)_{3-z},$$

where $M^I$ is selected from $Na^+$ and $Li^+$, $M^{II}$ is a divalent metal cation, $M^{III}$ is a trivalent metal cation, $M^V$ is a pentavalent metal cation, the Roman indices I, II, III, IV, V indicate the oxidation numbers in which the respective metal cations exist, and w, x, y, z are real numbers, where $0 \le x < 2$, $0 \le y < 2$, $0 \le w < 2$, $0 \le z < 3$, and where w, x, y, z are chosen such that $1+2w+x-y+z \ge 0$ and $2-w-x-y \ge 0$.

11. Process according to Embodiments 1 to 10, wherein $L_2$ <113> comprises the alcohol ROH and an alkali metal alkoxide XOR.

12. Process according to Embodiment 11, wherein the mass ratio of XOR to alcohol ROH in $L_2$ <113> is in the range from 1:100 to 1:5.

13. Process according to Embodiment 11 or 12, wherein the concentration of XOR in $L_1$ <115> is 1.01 to 2.2 times higher than in $L_2$ <113>.

14. Process according to any of Embodiments 1 to 13, wherein the concentration of X in $L_3$ <114> is in the range from 3.5 to 5 mol/l.

15. Process according to any of Embodiments 1 to 14, which is performed at a temperature of 20 to 70° C. and a pressure of 0.5 to 1.5 bar.

DETAILED DESCRIPTION OF THE INVENTION

Figures

Figure 1:
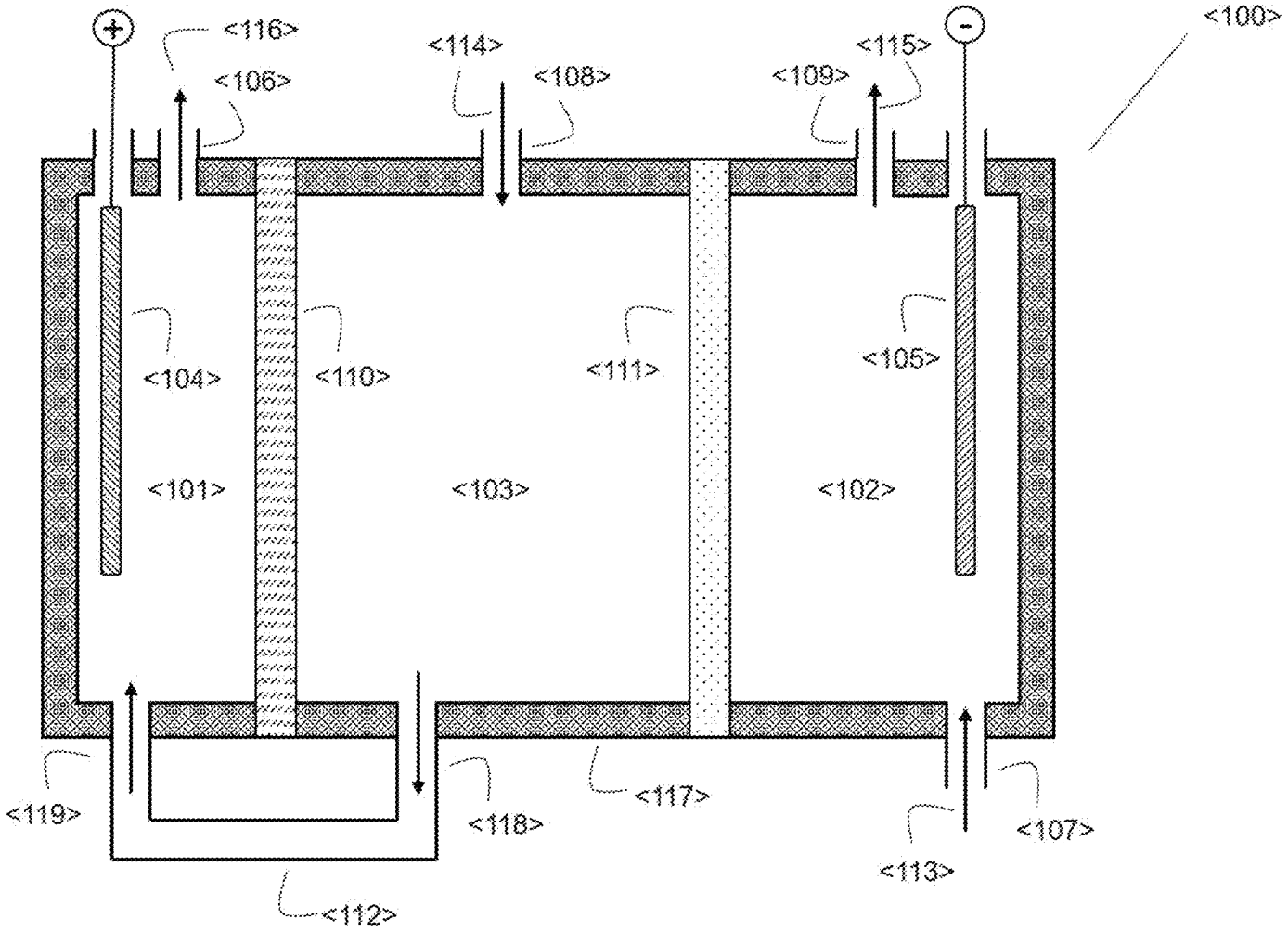
FIG. 1 shows the process according to the invention in a three-chamber cell E <100> comprising a cathode chamber $K_K$ <102>, an anode chamber $K_A$ <101> and an interposed middle chamber $K_M$ <103>.

FIG. 1 shows the process according to the invention in a three-chamber cell E <100> comprising a cathode chamber $K_K$ <102>, an anode chamber $K_A$ <101> and an interposed middle chamber $K_M$ <103>. The three chambers are bounded by an outer wall <117> of the three-chamber cell E <100>. The cathode chamber $K_K$ <102> is also separated from the middle chamber $K_M$ <103> by an NaSICON solid-state electrolyte $F_K$ <111> which is selectively permeable to sodium ions. The middle chamber $K_M$ <103> is additionally separated in turn from the anode chamber $K_A$ <101> by a diffusion barrier D <110>. The NaSICON solid-state electrolyte $F_K$ <111> and the diffusion barrier D <110> extend over the entire depth and height of the three-chamber cell E <100>.

A solution of sodium methoxide in methanol $L_2$ <113> is routed through the cathode chamber $K_K$ <102>. An aqueous solution of sodium chloride $L_3$ <114> with pH 10.5 is introduced through the inlet $Z_{KM}$ <108>, in the direction of gravity, into the middle chamber $K_M$ <103>. The connection $V_{AM}$ <112> formed between an outlet $A_{KM}$ <118> of the middle chamber $K_M$ <103> and an inlet $Z_{KA}$ <119> of the anode chamber $K_A$ <101> connects the middle chamber $K_M$ <103> to the anode chamber $K_A$ <101>. Sodium chloride solution $L_3$ <114> is routed through this connection $V_{AM}$ <112> from the middle chamber $K_M$ <103> into the anode chamber $K_A$ <101>. On application of a voltage, methanol is reduced to methoxide and $H_2$ in the cathode chamber $K_K$ <102>. At the same time, sodium ions diffuse from the middle chamber $K_M$ <103> through the NaSICON solid-state electrolyte $F_K$ <111> into the cathode chamber $K_K$ <102>. Overall, this increases the concentration of sodium methoxide in the cathode chamber $K_K$ <102>, which affords a methanolic solution of sodium methoxide $L_1$ <115>, the sodium methoxide concentration of which is elevated compared to $L_2$ <113>. In the anode chamber $K_A$ <101>, chloride ions from $L_3$ <114> are oxidized to $Cl_2$.

$Cl_2$ gives an acidic reaction in aqueous solution. Owing to the geometry of the three-chamber cell E <100> and the guiding of the aqueous solution $L_3$ <114>, the acid-sensitive NaSICON solid-state electrolyte <111> is protected from the elevated acidity, compared to $L_3$ <114>, of the solution $L_1$ <116> that results in the anode chamber $K_A$ <101>.

Figure 2:
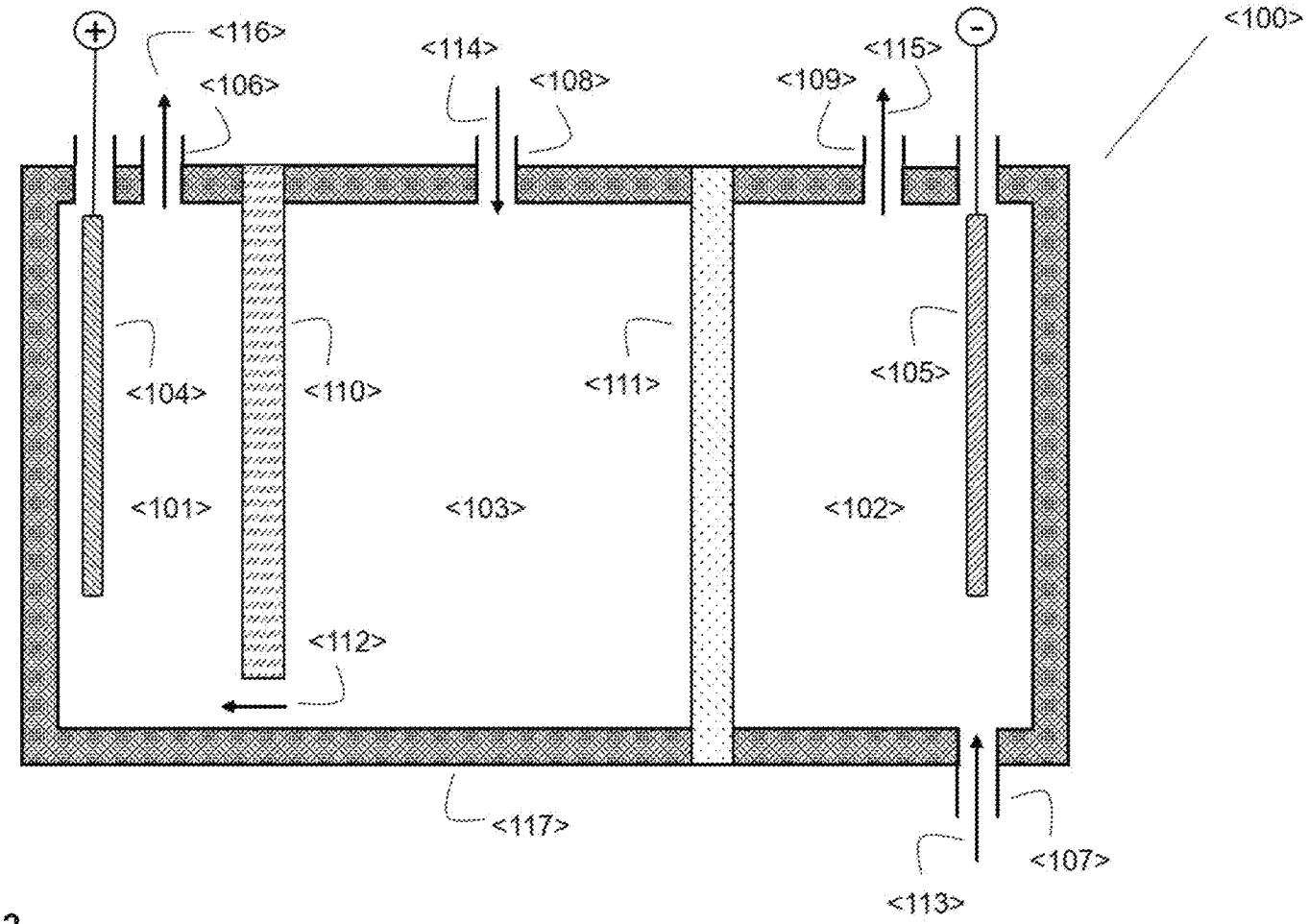
FIG. 2 shows an embodiment of the process according to the invention corresponding to that shown in FIG. 1.

FIG. 2 shows an embodiment of the process according to the invention corresponding to that shown in FIG. 1. The sole difference here is that the connection $V_{AM}$ <112> from the middle chamber $K_M$ <103> to the anode chamber $K_A$ <101> is formed by a perforation in the diffusion barrier D <110>.

Figure 3:
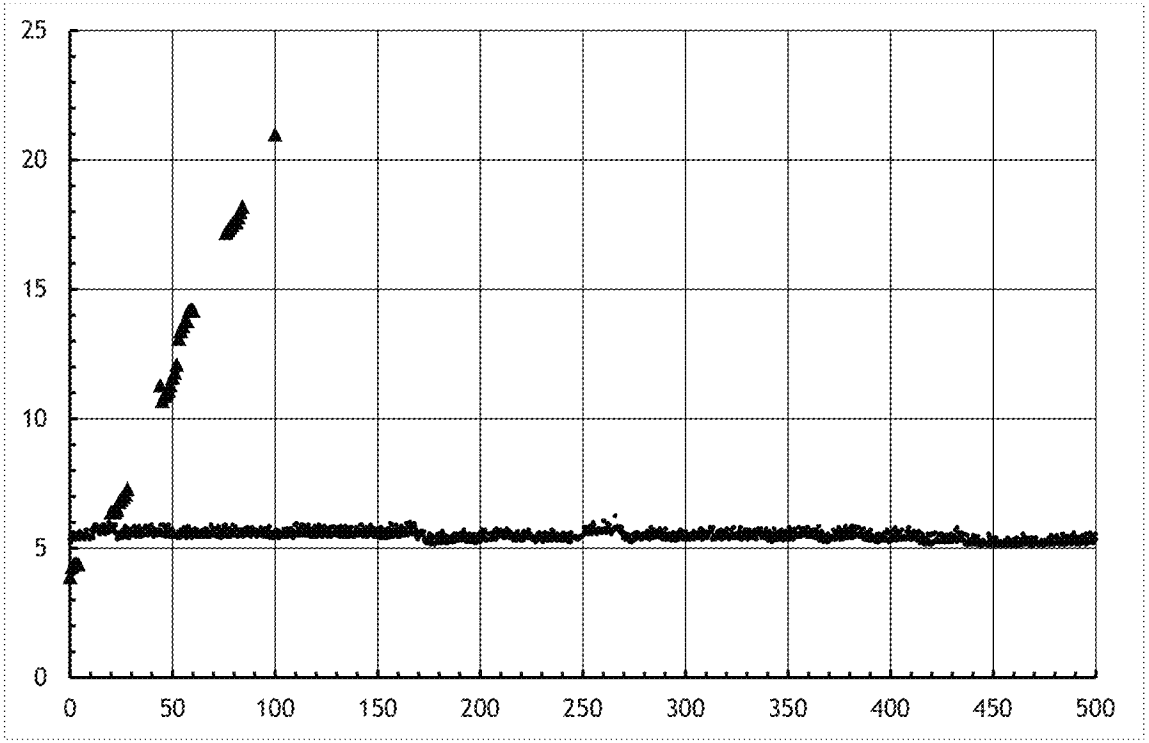
FIG. 3 shows a diagram of the progression of voltage in the electrolysis in a three-chamber cell according to the invention compared to a two-chamber cell.

FIG. 3 shows a diagram of the progression of voltage in the electrolysis in a three-chamber cell according to the invention compared to a two-chamber cell. The measurement points of the comparative example are represented by triangles (▲), and those of the inventive example by dots (•). The x axis shows the time in hours, while the y axis shows the voltage measured in volts. The comparison shows that the cell according to the invention gives a constant voltage progression, whereas the voltage rises rapidly in the case of the two-chamber cell owing to the destruction of the solid-state electrolyte.

Electrolysis Cell E

The process according to the invention is performed in an electrolysis cell E comprising at least one anode chamber $K_A$, at least one cathode chamber $K_K$ and at least one interposed middle chamber $K_M$. This also includes electrolysis cells E having more than one anode chamber $K_A$ and/or cathode chamber $K_K$ and/or middle chamber $K_M$. Such electrolysis cells in which these chambers are joined to one another in the form of modules are described, for example, in DD 258 143 A3, US 2006/0226022 A1.

The anode chamber $K_A$ comprises an anodic electrode $E_A$. A useful anodic electrode $E_A$ of this kind is any electrode familiar to the person skilled in the art that is stable under the conditions of the process according to the invention. These are described, in particular, in WO 2014/008410 A1, paragraph [024] or DE 10360758 A1, paragraph [031]. This electrode $E_A$ may consist of one layer or consist of multiple planar layers parallel to one another that may each be perforated or expanded. The anodic electrode $E_A$ especially comprises a material selected from the group consisting of ruthenium oxide, iridium oxide, nickel, cobalt, nickel tungstate, nickel titanate, precious metals such as, in particular, platinum, supported on a support such as titanium or Kovar® (an iron/nickel/cobalt alloy in which the individual components are preferably as follows: 54% by mass of iron, 29% by mass of nickel, 17% by mass of cobalt). Further possible anode materials are especially stainless steel, lead, graphite, tungsten carbide, titanium diboride. Preferably. $E_A$ comprises a titanium anode coated with ruthenium oxide/iridium oxide ($RuO_2$+$IrO_2$/Ti).

The cathode chamber $K_K$ comprises a cathodic electrode $E_K$. A useful cathodic electrode $E_K$ of this kind is any electrode familiar to the person skilled in the art that is stable under the conditions. These are described, in particular, in WO 2014/008410 A1, paragraph 10251 or DE 10360758 A1, paragraph 10301 This electrode $E_K$ may be selected from the group consisting of mesh wool, three-dimensional matrix structure and "balls". The cathodic electrode $E_K$ especially comprises a material selected from the group consisting of steel, nickel, copper, platinum, platinized metals, palladium, carbon-supported palladium, titanium. Preferably, $E_K$ comprises nickel.

The at least one middle chamber $K_M$ is between the anode chamber $K_A$ and the cathode chamber $K_K$.

The electrolysis cell E typically has an outer wall WA. The outer wall WA is especially selected from a material selected from the group consisting of steel, preferably rubberized steel, plastic, especially from Telene® (thermoset polydicyclopentadiene), PVC (polyvinylchloride), PVC-C (post-chlorinated polyvinylchloride), PVDF (polyvinylidenefluoride). $W_A$ may especially be permeated for inlets and outlets. Within $W_A$ are then the at least one anode chamber $K_A$, the at least one cathode chamber $K_K$ and the at least one interposed middle chamber $K_M$.

$K_M$ is separated from $K_A$ by a diffusion barrier D and from $K_K$ by an alkali metal cation-conducting solid-state electrolyte $F_K$.

The diffusion barrier D used may be any material that is stable under the conditions of the process according to the invention and prevents or slows the transfer of protons from the liquid present in the anode chamber $K_A$ into the middle chamber $K_M$.

The diffusion barrier D used is especially a non-ion-specific dividing wall or a membrane permeable to specific ions. The diffusion barrier D is preferably a membrane permeable to specific ions.

The material for the non-ionic dividing wall is especially selected from the group consisting of fabric, which is especially textile fabric or metal weave, glass, which is especially sintered glass or glass frits, ceramic, especially ceramic frits, membrane diaphragms.

If the diffusion barrier D is a "membrane permeable to specific ions", what this means in accordance with the invention is that the respective membrane promotes the diffusion of particular ions therethrough over others. More particularly, what this means is membranes that promote the diffusion therethrough of ions of a particular charge type over ions of the opposite charge. Even more preferably, membranes permeable to specific ions also promote the diffusion of particular ions of one charge type over other ions of the same charge type therethrough.

Preferably, the diffusion barrier D is accordingly an anion-conducting membrane or a cation-conducting membrane.

According to the invention, anion-conducting membranes are those that selectively conduct anions, preferably selectively conduct particular anions. In other words, they promote the diffusion of anions therethrough over that of cations, especially over protons; even more preferably, they additionally promote the diffusion of particular anions therethrough over the diffusion of other anions therethrough.

According to the invention, cation-conducting membranes are those that selectively conduct cations, preferably selectively conduct particular cations. In other words, they promote the diffusion of cations therethrough over that of anions; even more preferably, they promote the diffusion of particular cations therethrough over the diffusion of other cations therethrough, more preferably still that of cations that are not protons, more preferably sodium cations, over protons.

What is meant more particularly by "promote the diffusion of particular ions X over the diffusion of other ions Y" is that the coefficient of diffusion (unit: $m^2/s$) of ion type X at a given temperature for the membrane in question is higher by a factor of 10, preferably 100, preferably 1000, than the coefficient of diffusion of ion type Y for the membrane in question.

More preferably, the diffusion barrier D is an anion-conducting membrane since this particularly efficiently prevents the diffusion of protons from the anode chamber $K_A$ into the middle chamber $K_M$.

The anion-conducting membrane used is especially one selective for the anions included in the salt S. Such membranes are known to and can be used by the person skilled in the art.

Salt S is preferably a halide, sulfate, sulfite, nitrate, hydrogencarbonate or carbonate of X, more preferably a halide.

Halides are fluorides, chlorides, bromides, iodides. The most preferred halide is chloride.

The anion-conducting membrane used is preferably a membrane which is selective for halides, more preferably chloride.

Anion-conducting membranes are described, for example, by M. A. Hickner, A. M. Herring, E. B. Coughlin, Joumal of Polymer Science, Part B: Polymer Physics 2013, 51, 1727-1735 and C. G. Arges, V. Ramani, P. N. Pintauro, Electrochemical Society Interface 2010, 19, 31-35, WO 2007/048712 A2 and on page 181 of the textbook by Volkmar M. Schmidt, Elektrochemische Verfahrenstechnik: Grundlagen, Reaktionstechnik, Prozessoptimierung [Electrochemical Engineering: Fundamentals, Reaction Technology, Process Optimization], 1st edition (8 Oct. 2003).

Even more preferably, anion-conducting membranes used are accordingly organic polymers that are especially selected from polyethylene, polybenzimidazoles, polyether ketones, polystyrene, polypropylene and fluorinated membranes such as polyperfluoroethylene, preferably polystyrene, where these have covalently bonded functional groups selected from $—NH_3^+$, $—NRH_2^+$, $—NR_3^+$, $=NR^+$; $—PR_3^+$, where R is alkyl groups having preferably 1 to 20 carbon atoms, or other cationic groups. They preferably have covalently bonded functional groups selected from $—NH_3^+$, $—NRH_2^+$ and $—NR_3^+$, more preferably selected from $—NH_3^+$ and $—NR_3^+$, even more preferably $—NR_3^+$.

When the diffusion barrier D is a cation-conducting membrane, it is especially a membrane which is selective for the cations included in the salt S. Even more preferably, the diffusion barrier D is an alkali metal cation-conducting membrane, even more preferably still a potassium ion-conducting and/or sodium ion-conducting membrane, most preferably a sodium ion-conducting membrane.

Cation-conducting membranes are described, for example, on page 181 of the textbook by Volkmar M. Schmidt, Elektrochemische Verfahrenstechnik: Grundlagen, Reaktionstechnik, Prozessoptimierung, 1st edition (8 Oct. 2003).

Even more preferably, cation-conducting membranes used are accordingly organic polymers that are especially selected from polyethylene, polybenzimidazoles, polyether ketones, polystyrene, polypropylene and fluorinated membranes such as polyperfluoroethylene, preferably polystyrene and polyperfluoroethylene, where these bear covalently bonded functional groups selected from $—SO^-$, $—COO^-$, $—PO_3^{2-}$ and $—PO_2H^-$, preferably $—SO_3^-$ (described in DE 10 2010 062 804 A1, U.S. Pat. No. 4,831,146).

This may be, for example, a sulfonated polyperfluoroethylene (Nafion®, with CAS number; 31175-20-9). These are known to the person skilled in the art, for example from WO 2008/076327 A1, paragraph 10581, US 2010/0044242 A1, paragraph 100421 or US 2016/0204459 A1, and are commercially available under the Nafion®, Aciplex® F. Flemion®, Neosepta®, Ultrex®, PC-SK® trade names. Neosepta® membranes are described, for example, by S. A. Mareev. D. Yu. Butylskii, N. D. Pismenskaya. C. Larchet, L. Dammak, V. V. Nikonenko, Journal of Membrane Science 2018, 563, 768-776.

If a cation-conducting membrane is used as diffusion barrier D, this may, for example, be a polymer functionalized with sulfonic acid groups, especially of the formula $P_{NAFION}$ below, where n and m may independently be a w % bole number from 1 to $10^6$, preferably a whole number from 10 to $10^5$, more preferably a whole number from $10^2$ to $10^4$.

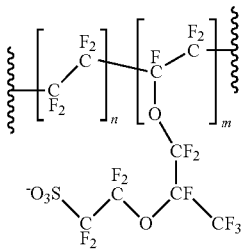

$P_{Nafion}$

A useful alkali metal cation-conducting solid-state electrolyte $F_K$ is any solid-state electrolyte that can transport cations, in particular alkali metal cations, even more preferably sodium cations, from the middle chamber $K_M$ into the cathode chamber $K_K$. Such solid-state electrolytes are known to the person skilled in the art and are described, for example, in DE 10 2015 013 155 A1, in WO 2012/048032 A2, paragraphs 100351, [0039], [0040], in US 2010/0044242 A1, paragraphs [0040], [0041], in DE 10360758 A1, paragraphs [014] to [025]. They are sold commercially under the NaSICON, LiSICON, KSICON name. A sodium ion-conducting solid-state electrolyte $F_K$ is preferred, wherein the latter more preferably has an NaSICON structure. NaSICON structures usable in accordance with the invention are also described, for example, by N. Anantharamulu, K. Koteswara Rao, G. Rambabu, B. Vijaya Kumar, Velchuri Radha, M. Vithal, *J Mater Sci* 2011, 46, 2821-2837.

NaSICON preferably has a structure of the formula $M^{I}_{1+2w+x-y+z}M^{II}_{w}M^{III}_{x}Zr^{IV}_{2-w-x-y}M^{V}_{y}(SiO_4)_z(PO_4)_{3-z}$.

$M^{I}$ is selected from $Na^+$, $Li^+$, preferably $Na^+$.

$M^{II}$ is a divalent metal cation, preferably selected from $Mg^{2+}$, $Ca^{2+}$, $Sr^{2+}$, $Ba^{2+}$, $Co^{2+}$, $Ni^{2+}$, more preferably selected from $Co^{2+}$, $Ni^{2+}$.

$M^{III}$ is a trivalent metal cation, preferably selected from $Al^{3+}$, $Ga^{3+}$, $Sc^{3+}$, $La^{3+}$, $Y^{3+}$, $Gd^{3+}$, $Sm^{3+}$, $Lu^{3+}$, $Fe^{3+}$, $Cr^{3+}$, more preferably selected from $Sc^{3+}$, $La^{3+}$, $Y^{3+}$, $Gd^{3+}$, $Sm^{3+}$, especially preferably selected from $Sc^{3+}$, $Y^{3+}$, $La^{3+}$.

My is a pentavalent metal cation, preferably selected from $V^{5+}$, $Nb^{5+}$, $Ta^{5+}$.

The Roman indices I, II, III, IV, V indicate the oxidation numbers in which the respective metal cations exist.

w, x, y, z are real numbers, where $0 \le x < 2$, $0 \le y < 2$, $0 \le w < 2$, $0 \le z < 3$, and where w, x, y, z are chosen such that $1+2w+x-y+z \ge 0$ and $2-w-x-y \ge 0$.

Even more preferably in accordance with the invention, NaSICON has a structure of the formula $Na_{(1+v)}Zr_2Si_vP_{(3-v)}O_{12}$ where v is a real number for which $0 \le v \le 3$. Most preferably, v=2.4.

The cathode chamber $K_K$ also comprises an inlet $Z_{KK}$ and an outlet $A_{KK}$ that enables addition of liquid, for example the solution $L_2$, to the cathode chamber $K_K$ and removal of liquid present therein, for example the solution $L_1$. The inlet $Z_{KK}$ and the outlet $A_{KK}$ are mounted on the cathode chamber $K_K$ in such a way that the solution comes into contact with the cathodic electrode $E_K$ as it flows through the cathode chamber $K_K$. This is a prerequisite for the solution $L_1$ being obtained at the outlet $A_{KK}$ in the performance of the process according to the invention when the solution $L_2$ of an alkali metal alkoxide XOR in the alcohol ROH is routed through $K_K$.

The anode chamber $K_A$ also comprises an outlet $A_{KA}$ that enables removal of liquid present in the anode chamber $K_A$, for example the aqueous solution $L_4$. In addition, the middle chamber $K_M$ comprises an inlet $Z_{KM}$, while $K_A$ and $K_M$ are connected to one another by a connection $V_{AM}$. As a result, it is possible to add a solution $L_3$ to $K_M$ and then route it through $K_M$, and to route it via $V_{AM}$ into the anode chamber $K_A$, then through this $K_A$. $V_{AM}$ and the outlet $A_{KA}$ are mounted on the anode chamber $K_A$ in such a way that the solution $L_3$ comes into contact with the anodic electrode $E_A$ as it flows through the anode chamber $K_A$. This is a prerequisite for the aqueous solution $L_4$ being obtained at the outlet $A_{KA}$ in the performance of the process according to the invention when the solution $L_3$ is routed first through $K_M$, then $V_{AM}$, then $K_A$.

Inlets $Z_{KK}$, $Z_{KM}$, $Z_{KA}$ and outlets $A_{KK}$, $A_{KA}$, $A_{KM}$ may be mounted on the electrolysis cell by methods known to the person skilled in the art.

The connection $V_{AM}$ may be formed within the electrolysis cell E and/or outside the electrolysis cell E, If the connection $V_{AM}$ is formed within the electrolysis cell E, it is preferably formed by at least one perforation in the diffusion barrier D.

If the connection $V_{AM}$ is formed outside the electrolysis cell E, it is preferably formed by a connection of $K_M$ and $K_A$ that runs outside the electrolysis cell E, especially in that an outlet $A_{KM}$ is formed in the middle chamber $K_M$ through the outer wall $W_A$, preferably at the base of the middle chamber $K_M$, the inlet $Z_{KM}$ more preferably being at the top end of the middle chamber $K_M$, and an inlet $Z_{KA}$ is formed in the anode chamber $K_A$ through the outer wall WA, preferably at the base of the anode chamber $K_A$, and these are preferably connected by a conduit, for example a pipe or a hose, preferably comprising a material selected from rubber and plastic. The outlet $A_{KA}$ is then more preferably at the top end of the anode chamber $K_A$.

"Outlet $A_{KM}$ at the base of the middle chamber $K_M$" means that the outlet $A_{KM}$ is mounted on the electrolysis cell E in such a way that the solution $L_3$ leaves the middle chamber $K_M$ in the direction of gravity.

"Inlet $Z_{KA}$ at the base of the anode chamber $K_A$" means that the inlet $Z_{KA}$ is mounted on the electrolysis cell E in such a way that the solution $L_3$ enters the anode chamber $K_A$ counter to gravity.

"Inlet $Z_{KM}$ at the top end of the middle chamber $K_M$" means that the inlet $Z_{KM}$ is mounted on the electrolysis cell E in such a way that the solution $L_3$ enters the middle chamber $K_M$ in the direction of gravity.

"Outlet $A_{KA}$ at the top end of the anode chamber $K_A$" means that the outlet $A_{KA}$ is mounted on the electrolysis cell E in such a way that the solution $L_4$ leaves the anode chamber $K_A$ counter to gravity.

This embodiment is particularly advantageous and therefore preferred when the outlet $A_{KM}$ is formed by the outer wall $W_A$ at the base of the middle chamber $K_M$, and the inlet $Z_{KA}$ by the outer wall $W_A$ at the base of the anode chamber $K_A$. This arrangement makes it possible in a particularly simple manner to separate gases formed in the middle chamber $K_M$ from $L_3$ via the gas outlet G, while gases formed in the anode chamber $K_A$ leave the anode chamber $K_A$ with $L_4$ and can then be separated off further.

Accordingly, the flow direction of $L_3$ into $K_M$ is the opposite of or the same as the flow direction of $L_3$ into $K_A$, preferably the opposite, according to how the connection $V_{AM}$ is mounted on the electrolysis cell E. Preferably, the flow direction of $L_3$ into $K_M$ is in the direction of gravity.

In a preferred embodiment of the present invention, connection $V_{AM}$ between middle chamber $K_M$ and anode chamber $K_A$ is arranged such that at least part of the aqueous solution $L_3$, preferably the entire aqueous solution $L_3$, flows completely through the middle chamber $K_M$ and the anode chamber $K_A$.

When the connection $V_{AM}$ <112> is formed outside the electrolysis cell E <100>, this may especially be implemented in that $Z_{KM}$ <108> and $A_{KM}$ <118> are arranged at opposite ends of the outer wall $W_A$ <117> of the middle chamber $K_M$ <103> (i.e. $Z_{RM}$ <108> at the base and $A_{KM}$ <118> at the top end of the electrolysis cell E <100> or vice versa) and $Z_{KA}$ <119> and $A_{KA}$ <106> are arranged at opposite ends of the outer wall $W_A$ <117> of the anode chamber $K_A$ <101> (i.e. $Z_{KA}$ <119> at the base and $A_{KA}$ <106> at the upper end of the electrolysis cell E <100> or vice versa), as shown more particularly in FIG. 1. By virtue of this geometry, $L_3$ <114> must flow through the two chambers $K_M$ <103> and $K_A$ <101>. It is possible here for $Z_{KA}$ <119> and $Z_{KM}$ <108> to be formed on the same side of the electrolysis cell E <100>, in which case $A_{KM}$ <118> and $A_{KA}$ <106> are automatically also formed on the same side of the electrolysis cell E <100>. Alternatively, as shown in FIG. 1, it is possible for $Z_{KA}$ <119> and $Z_{KM}$ <108> to be formed on opposite sides of the electrolysis cell E <100>, in which case $A_{KM}$ <118> and $A_{KA}$ <106> are automatically also formed on opposite sides of the electrolysis cell E <100>.

When the connection $V_{AM}$ <112> is formed within the electrolysis cell E <100>, this may especially be implemented in that one side ("side A") of the electrolysis cell E <100>, which is the top end or the base of the electrolysis cell E <100>, preferably the top end as shown in FIG. 2, comprises the inlet $Z_{KM}$<108> and the outlet $A_{KA}$ <106>, and the diffusion barrier D <110> extends proceeding from this side A into the electrolysis cell <100>, but does not quite reach up to the side ("side B") of the electrolysis cell E <100> opposite side A, which is then the base or the top end of the electrolysis cell E <100>, and at the same time covers 50% or more of the height of the three-chamber cell E <100>, preferably 60% to 99% of the height of the three-chamber cell E <100>, more preferably 70% to 95% of the height of the three-chamber cell E <100>, even more preferably 80% to 90% of the height of the three-chamber cell E <100>, more preferably still 85% of the height of the three-chamber cell E <100>. Because the diffusion barrier D <110> does not touch side B of the three-chamber cell E <100>, a gap thus arises between diffusion barrier D <110> and the outer wall $W_A$ of side B of the three-chamber cell E <100>. In that case, the gap is the connection $VA_{AM}$ <112>. By virtue of this geometry. $L_3$ must flow completely through the two chambers $K_M$ and $K_A$.

These embodiments best assure that the aqueous salt solution $L_3$ flows past the acid-sensitive solid-state electrolyte before it comes into contact with the anodic electrode $E_A$ <104>, which results in the formation of acids.

According to the invention, "base of the electrolysis cell E" is the side of the electrolysis cell E through which a solution (e.g. $L_3$ <114> in the case of $A_{KM}$ <118> in FIG. 1) exits from the electrolysis cell E in the direction of gravity, or the side of the electrolysis cell E through which a solution (e.g. $L_2$ <113> in the case of $Z_{KK}$ <107> in FIGS. 1 and 2, and $L_3$ <114> in the case of $A_{KA}$ <119> in FIG. 1) is supplied to the electrolysis cell E counter to gravity.

According to the invention, "top end of the electrolysis cell E" is the side of the electrolysis cell E through which a solution (e.g. $L_4$ <116> in the case of $A_{KA}$ <106> and $L_1$ <115> in the case of $A_{KK}$ <109> in FIGS. 1 and 2) exits from the electrolysis cell E counter to gravity, or the side of the electrolysis cell E through which a solution (e.g. $L_3$ <114> in the case of $Z_{KM}$ <108> in FIGS. 1 and 2) is supplied to the electrolysis cell E in the direction of gravity.

Process Steps According to the Invention

The process according to the invention comprises steps (a), (b) and (c) as follows, which are performed simultaneously.

In step (a), a solution $L_2$ comprising the alcohol ROH, preferably comprising an alkali metal alkoxide XOR in the alcohol ROH, is routed through $K_K$. X is an alkali metal cation and R is an alkyl radical having 1 to 4 carbon atoms.

Preferably, X is selected from the group consisting of $Li^+$, $K^+$, $Na^+$, more preferably from the group consisting of $K^+$, $Na^+$. Most preferably X=$Na^+$.

R is preferably selected from the group consisting of n-propyl, iso-propyl, ethyl and methyl, more preferably from the group consisting of ethyl and methyl. R is most preferably methyl.

Solution $L_2$ is preferably free of water. What is meant in accordance with the invention by "free of water" is that the weight of water in solution $L_2$ based on the weight of the alcohol ROH in solution $L_2$ (mass ratio) is ≤1:10, more preferably ≤1:20, even more preferably ≤1:100, even more preferably ≤0.5:100.

If solution $L_2$ comprises XOR, the proportion by mass of XOR in solution $L_2$, based on the overall solution $L_2$, is especially >0% to 30% by weight, preferably 5% to 20% by weight, more preferably 10% to 20% by weight, more preferably 10% to 15% by weight, most preferably 13% to 14% by weight, at the very most preferably 13% by weight.

If solution $L_2$ comprises XOR, the mass ratio of XOR to alcohol ROH in solution $L_2$ is especially in the range of 1:100 to 1:5, more preferably in the range of 1:25 to 3:20, even more preferably in the range of 1:12 to 1:8, even more preferably 1:10.

In step (b), a neutral or alkaline, aqueous solution $L_3$ of a salt S comprising X as cation is routed through $K_M$, then via $V_{AM}$, then through $K_A$.

The salt S is described above. The pH of the aqueous solution $L_3$ is ≥7.0, preferably in the range of 7 to 12, more preferably in the range of 8 to 11, even more preferably 10 to 11, most preferably 10.5.

The proportion by mass of salt S in solution $L_3$ is preferably in the range of >0% to 20% by weight, preferably 1% to 20% by weight, more preferably 5% to 20% by weight, even more preferably 10% to 20% by weight, most preferably 20% by weight, based on the overall solution $L_3$.

In step (c), it is then possible to apply a voltage between $E_A$ and $E_K$.

This results in transfer of current from the charge source to the anode, transfer of charge via ions to the cathode and ultimately transfer of current back to the charge source. The charge source is known to the person skilled in the art and is typically a rectifier that converts alternating current to direct current and can generate particular voltages via voltage transformers.

This leads in turn to the following consequences:

solution $L_1$ <115> is obtained at the outlet $A_{KK}$ <109>, wherein the concentration of XOR in $L_1$ <115> is higher than in $L_2$ <113>, an aqueous solution $L_4$ <116> of S is obtained at the outlet $A_{KA}$ <106>, wherein the concentration of S in $L_1$ <116> is lower than in $L_3$ <114>.

In the process according to the invention, in particular, such a voltage is applied that such a current flows that the current density (=ratio of the current which flows to the electrolysis cell to the area of the solid-state electrolyte in contact with the anolyte present in the middle chamber $K_M$)

is in the range from 10 to 8000 $A/m^2$, more preferably in the range from 100 to 2000 $A/m^2$, even more preferably in the range from 300 to 800 $A/m^2$, even more preferably is 494 $A/m^2$. This can be determined in a standard manner by the person skilled in the art. The area of the solid-state electrolyte in contact with the anolyte present in the middle chamber $K_M$ is especially 0.00001 to 10 m2, preferably 0.0001 to 2.5 $m^2$, more preferably 0.0002 to 0.15 $m^2$, even more preferably 2.83 $cm^2$.

It will be apparent that, in the process according to the invention, step (c) is performed when the two chambers $K_M$ and $K_A$ are at least partly laden with $L_3$ and $K_K$ is at least partly laden with $L_2$.

The fact that transfer of charge takes place between $E_A$ and $E_K$ in step (c) implies that $K_K$, $K_M$ and $K_A$ are simultaneously laden with $L_2$ and $L_3$ such that they cover the electrodes $E_A$ and $E_K$ to such an extent that the circuit is complete.

This is the case especially when a liquid stream of $L_3$ is routed continuously through $K_M$, $V_{AM}$ and $K_A$ and a liquid stream of $L_2$ through $K_K$, and the liquid stream of $L_3$ covers electrode $E_A$ and the liquid stream of $L_2$ covers electrode $E_K$ at least partly, preferably completely.

In a further preferred embodiment, the process according to the invention is performed continuously. i.e. step (a) and step (b) are performed continuously, while applying voltage as per step (c).

After performance of step (c), solution $L_1$ is obtained at the outlet $A_{KK}$, wherein the concentration of XOR in $L_1$ is higher than in $L_2$. If $L_2$ already comprised XOR, the concentration of XOR in $L_1$ is preferably 1.01 to 2.2 times, more preferably 1.04 to 1.8 times, even more preferably 1.077 to 1.4 times, even more preferably 1.077 to 1.08 times, higher than in $L_2$, most preferably 1.077 times higher than in $L_2$, where the proportion by mass of XOR in $L_1$ and in $L_2$ is more preferably in the range from 10% to 20% by weight, even more preferably 13% to 14% by weight.

At the outlet $A_{KA}$, an aqueous solution $L_4$ of S is obtained, where the concentration of S in $L_4$ is lower than in $L_3$.

The concentration of cation X in the aqueous solution $L_3$ is preferably in the range of 3.5 to mol/1, more preferably 4 mol/1. The concentration of cation X in the aqueous solution $L_4$ is more preferably 0.5 mol/1 lower than that of the aqueous solution $L_3$ used in each case.

In particular, the process according to the invention is performed at a temperature of 20° C. to 70° C., preferably 35° C. to 65° C., more preferably 35° C. to 60° C., even more preferably 35° C. to 50° C., and a pressure of 0.5 bar to 1.5 bar, preferably 0.9 to 1.1 bar, more preferably 1.0 bar.

In the course of performance of the process according to the invention, hydrogen is typically formed in the cathode chamber $K_K$, which can be removed from the cell together with solution $L_1$ via outlet $A_{KK}$. The mixture of hydrogen and solution $L_1$ can then, in a particular embodiment of the present invention, be separated by methods known to the person skilled in the art. If the alkali metal compound used is a halide, especially chloride, chlorine or another halogen gas can form in the anode chamber $K_A$, which can be removed from the cell together with solution $L_4$ via outlet $A_{KK}$. In addition, there may also be formation of oxygen and/or carbon dioxide, which can likewise be removed. The mixture of chlorine, oxygen and/or $CO_2$ and solution $L_4$ may then, in a particular embodiment of the present invention, be separated by methods known to the person skilled in the art. It is then likewise possible, after the gases chlorine, oxygen and/or $CO_2$ have been separated from solution $L_4$, to separate these from one another by methods known to the person skilled in the art.

These results were surprising and unexpected in the light of the prior art. The process according to the invention protects the acid-labile solid-state electrolyte from corrosion without, as in the prior art, having to sacrifice alkoxide solution from the cathode space as buffer solution. Thus, the process according to the invention is more efficient than the procedure described in WO 2008/076327 A1, in which the product solution is used for the middle chamber, which reduces the overall conversion.

Preferred Embodiments of the Invention

FIG. 1 shows a preferred embodiment of the invention in a three-chamber cell E <100>. This comprises a cathode chamber $K_K$ <102>, a middle chamber $K_M$ <103> and an anode chamber $K_A$ <101>. The anode chamber $K_A$ <101> and the middle chamber $K_M$ <103> are separated from one another by an anion exchange membrane as diffusion barrier D <110> that extends over the entire cross section of the three-chamber cell E <100>. The cathode chamber $K_K$ <102> and the middle chamber $K_M$ <103> are separated from one another by a permeable solid-state electrolyte (NaSICON) <111> selective for sodium ions, which extends over the entire cross section of the three-chamber cell E <100>. The cathode chamber $K_K$ <102> comprises a cathodic electrode $E_K$ <105>, an inlet $Z_{KK}$ <107> and an outlet $A_{KK}$ <109>.

The anode chamber $K_A$ <101> comprises an anodic electrode $E_A$ <104> and an outlet $A_{KA}$ <106> and is connected to the middle chamber $K_M$ <103> via the connection $V_{AH}$<112>. The middle chamber $K_M$ <103> additionally comprises an inlet $Z_{KM}$<108>. In the embodiment according to FIG. 1, the connection $V_{AM}$ <112> is formed outside the electrolysis cell E <100>, especially by a pipe or hose, the material of which may be selected from rubber, metal and plastic, with which liquid can be routed from the middle chamber $K_M$ <103> into the anode chamber $K_A$ <101> outside the outer wall $W_A$ <117> of the three-chamber cell E <100>. The connection $V_{AM}$ <112> connects an outlet $A_{KM}$ <118> that penetrates the outer wall $W_A$ <117> of the electrolysis cell E <100> at the base of the middle chamber $K_M$ <103> to an inlet $Z_{KA}$ <119> that penetrates the outer wall $W_A$ <117> of the electrolysis cell E <100> at the base of the anode chamber $K_A$ <101>.

An electrolyte $L_2$ <113> is routed into the cathode chamber $K_K$ <102> via the inlet $Z_{KK}$ <107>. The electrolyte $L_2$ <113> comprises methanol; the electrolyte $L_2$ <113> used is preferably a methanolic solution of sodium methoxide $L_2$ <113>.

At the same time, an aqueous NaCl solution $L_3$ <114> with pH 10.5 is introduced into the middle chamber $K_M$ <103> via the inlet $Z_{KM}$ <108>. This flows through the middle chamber $K_M$ <103> and the connection $V_{AM}$ <112> into the anode chamber $K_A$ <101>.

At the same time, a voltage is applied between the cathodic electrode $E_K$ <105> and the anodic electrode $E_A$ <104>. This results in reduction of methanol in the electrolyte $L_2$ <113> to give methoxide and $H_2$ in the cathode chamber $K_K$ <102> ($CH_3OH+e^- \rightarrow CH_3O^- + \frac{1}{2}H_2$). In the anode chamber $K_A$ <101>, the oxidation of chloride ions takes place to give molecular chlorine ($Cl^- \rightarrow \frac{1}{2}Cl_2 + e^-$). Chlorine gas ($Cl_2$) in water, according to the reaction $Cl_2 + H_2O \rightarrow HOCl + HCl$, forms hypochlorous acid and hydrochloric acid, which give an acidic reaction with further water molecules. The acidity damages the NaSICON solid-state electrolyte <111>, but is restricted to the anode chamber $K_A$ <101> by the arrangement according to the invention, and hence kept away from the NaSICON solid-state electrolyte $F_K$ <111> in the electrolysis cell E <100>. This considerably increases the lifetime thereof.

At the same time, sodium ions diffuse from the middle chamber $K_M$ <103> through the NaSICON solid-state electrolyte <111> into the cathode chamber $K_K$ <102>. Overall, this increases the concentration of sodium methoxide in the cathode chamber $K_K$ <102>, which affords a methanolic solution of sodium methoxide $L_1$ <115>, the sodium methoxide concentration of which is elevated compared to $L_2$ <113>. Owing to the geometry of the three-chamber cell E <100> and the guiding of the aqueous solution $L_3$ <114> according to the invention, the acid-sensitive NaSICON solid-state electrolyte <111> is protected from the elevated acidity, compared to $L_3$ <114>, of the solution $L_4$ <116> that results in the anode chamber $K_A$ <101>.

The embodiment of the present invention shown in FIG. 2 corresponds to that shown in FIG. 1. The only difference here is that the connection $V_{AM}$ <112> within the electrolysis cell E <100> takes such a form that the diffusion barrier D <110> does not extend over the entire cross section of the three-chamber cell E <100>. The connection $V_{AM}$ <112> from the middle chamber $K_M$ <103> to the anode chamber $K_A$ <101> is thus formed by a gap in the diffusion barrier D <110>. In further preferred embodiments of the present invention, it is also possible to utilize diffusion barriers D <110> having more than one gap, such that the connection $V_{AM}$ <112> between middle chamber $K_M$ <103> and anode chamber $K_A$ <101> is formed by multiple gaps.

EXAMPLES

Inventive Example

Sodium methoxide (SM) was prepared via a cathodic process, wherein 20% by weight NaCl solution (in water) is supplied in the anode chamber and 10% by weight methanolic SM solution in the cathode chamber. The electrolysis cell consisted of three chambers, as shown in FIG. 1, and the anolyte was transferred through the middle chamber into the anode chamber. The connection between middle chamber and anode chamber was established by a hose mounted at the base of the electrolysis cell. The anode chamber and middle chamber were separated by a 2.83 $cm^2$ anion exchange membrane (Tokuyama AMX, ammonium groups on polymer). Cathode chamber and middle chamber were separated by a ceramic of the NaSICON type with an area of 2.83 $cm^2$. The ceramic has a chemical composition of the formula $Na_{3.4}Zr_{2.0}Si_{2.4}P_{0.6}O_{12}$. The flow rate of the anolyte and that of the catholyte was 90 ml/h in each case, and a current of 0.14 A was applied. The temperature was 35° C. The progression of voltage (in V) over time (in hours) is shown in FIG. 3 (•).

Comparative Example

The process was repeated with a two-chamber cell comprising solely an anode chamber and a cathode chamber, with separation of the anode chamber from the cathode chamber by the ceramic of the NaSICON type. This electrolysis cell thus did not contain a middle chamber. This results in more rapid corrosion of the ceramic compared to the inventive example, which leads to a rapid rise in the voltage curve, see FIG. 3, (▲).

Result

The use of a three-chamber cell as in the process according to the invention prevents the corrosion of the solid-state electrolyte, and at the same time there is no need to sacrifice alkali metal alkoxide product for the middle chamber.

The invention claimed is:

1. A process for preparing a solution $L_1$ of an alkali metal alkoxide XOR in an alcohol ROH in an electrolysis cell E, wherein E comprises at least one anode chamber $K_A$, at least one cathode chamber $K_K$, and at least one interposed middle chamber $K_M$, the process comprising:

(a) routing a solution $L_2$ comprising the alcohol ROH through the at least one cathode chamber $K_K$, (b) routing a neutral or alkaline, aqueous solution $L_3$ of a salt S comprising X as cation through the at least one interposed middle chamber $K_M$, then via a connection $V_{AM}$, through the at least one anode chamber $K_A$, and (c) applying voltage between an anodic electrode $E_A$ and a cathodic electrode $E_K$, wherein (a), (b), and (c) are performed simultaneously, wherein the at least one anode chamber $K_A$ comprises the anodic electrode $E_A$ and an outlet $A_{KA}$, wherein the at least one cathode chamber $K_K$ comprises the cathodic electrode $E_K$, an inlet $Z_{KK}$, and an outlet $A_{KK}$, wherein the at least one interposed middle chamber $K_M$ comprises an inlet $Z_{KM}$, wherein the at least one interposed middle chamber $K_M$ is separated from the at least one anode chamber $K_A$ by a diffusion barrier D, and is separated from the at least one cathode chamber $K_K$ by an alkali metal cation-conducting solid-state electrolyte $F_K$, wherein the at least one interposed middle chamber $K_M$ and the at least one anode chamber $K_A$ are connected to one another by the connection $V_{AM}$ through which liquid can be routed from the at least one interposed middle chamber $K_M$ into the at least one anode chamber $K_A$, wherein the process affords the solution $L_1$ at the outlet $A_{KK}$, wherein the concentration of XOR in the solution $L_1$ is higher than in the solution $L_2$, wherein the process affords an aqueous solution $L_4$ of the salt S at the outlet $A_{KA}$, wherein the concentration of the salt S in the solution $L_4$ is lower than in the solution $L_3$, and wherein X is an alkali metal cation and R is an alkyl radical having 1 to 4 carbon atoms.

2. The process according to claim 1, wherein X is selected from the group consisting of $Li^+$, $Na^+$, and $K^+$.

3. The process according to claim 1, wherein the salt S is a halide, sulfate, sulfite, nitrate, hydrogencarbonate, or carbonate of X.

4. The process according to claim 1, wherein R is selected from the group consisting of methyl and ethyl.

5. The process according to claim 1, wherein the diffusion barrier D is selected from the group consisting of cation-conducting membranes and anion-conducting membranes.

6. The process according to claim 5, wherein the diffusion barrier D is a sodium cation-conducting membrane.

7. The process according to claim 1, wherein a flow direction of the solution $L_3$ in the middle chamber $K_M$ is the opposite of a flow direction of the solution $L_3$ in the anode chamber $K_A$.

8. The process according to claim 1, wherein the connection $V_{AM}$ is formed within and/or outside the electrolysis cell E.

9. The process according to claim 1, wherein the connection $V_{AM}$ between the middle chamber $K_M$ and the anode chamber $K_A$ is arranged in such a way that at least a portion of the aqueous solution $L_3$ flows completely through the middle chamber $K_M$ and the anode chamber $K_A$.

10. The process according to claim 1, wherein the alkali metal ion-conducting solid-state electrolyte $F_K$ has a structure of the formula $$M^{I}_{1+2w+x-y+z}M^{II}_{w}M^{III}_{x}Zr^{IV}_{2-w-x-y}M^{V}_{y}(SiO_4)_z(PO_4)_{3-z},$$

wherein $M^{I}$ is selected from $Na^+$ and $Li^+$, $M^{II}$ is a divalent metal cation, $M^{III}$ is a trivalent metal cation, $M^{V}$ is a pentavalent metal cation, and the Roman indices I, II, III, IV, V indicate the oxidation numbers in which the respective metal cations exist, and wherein w, x, y, z are real numbers, wherein $0 \leq x < 2$, $0 \leq y < 2$, $0 \leq w < 2$, $0 \leq z < 3$, and wherein w, x, y, z are chosen such that $1+2w+x-y+z \geq 0$ and $2-w-x-y \geq 0$.

11. The process according to claim 1, wherein the solution $L_2$ comprises the alcohol ROH and the alkali metal alkoxide XOR.

12. The process according to claim 11, wherein the mass ratio of the alkali metal alkoxide XOR to the alcohol ROH in the solution $L_2$ is in the range from 1:100 to 1:5.

13. The process according to claim 11, wherein the concentration of the alkali metal alkoxide XOR in $L_1$ is 1.01 to 2.2 times higher than in the solution $L_2$.

14. The process according to claim 1, wherein a concentration of X in the solution $L_3$ is in the range from 3.5 to 5 mol/l.

15. The process according to claim 1, wherein the process is performed at a temperature of 20 to 70° C. and a pressure of 0.5 to 1.5 bar.

* * * * *